United States Patent [19]

Focke

[11] Patent Number: 4,916,883

[45] Date of Patent: Apr. 17, 1990

[54] PROCESS AND APPARATUS FOR THE TESTING OF PACKS

[75] Inventor: Heinz Focke, Verden, Fed. Rep. of Germany

[73] Assignee: Focke & Co. (GmbH & Co.), Verden, Fed. Rep. of Germany

[21] Appl. No.: 171,342

[22] Filed: Mar. 21, 1988

[30] Foreign Application Priority Data

Mar. 20, 1987 [DE] Fed. Rep. of Germany ..... 3709289

[51] Int. Cl.[4] ..... B65B 23/10; B65B 57/10

[52] U.S. Cl. ..... 53/53; 53/54; 53/494; 209/601

[58] Field of Search ..... 53/54, 53, 494; 209/539, 598, 600, 601, 602, 936

[56] References Cited

U.S. PATENT DOCUMENTS

| | | | |
|---|---|---|---|
| 2,367,684 | 1/1945 | Malhiot | 53/75 X |
| 3,237,764 | 3/1966 | Kochalski et al. | 209/539 X |
| 3,346,112 | 10/1967 | Brown et al. | 209/600 X |
| 4,053,056 | 10/1977 | Day | 209/617 X |
| 4,235,061 | 11/1980 | Watanabe et al. | 53/54 |
| 4,363,332 | 12/1982 | Preston et al. | 209/602 X |
| 4,510,730 | 4/1985 | Edmondson | 53/53 |
| 4,612,803 | 9/1986 | Manservisi et al. | 53/54 X |
| 4,742,668 | 5/1988 | Ecabert | 53/494 |

FOREIGN PATENT DOCUMENTS

| | | | |
|---|---|---|---|
| 1104421 | 4/1961 | Fed. Rep. of Germany . | |
| 457657 | 7/1963 | Fed. Rep. of Germany . | |
| 1208679 | 1/1966 | Fed. Rep. of Germany . | |
| 1275947 | 8/1968 | Fed. Rep. of Germany . | |
| 3240254 | 5/1984 | Fed. Rep. of Germany . | |
| 229367 | 11/1985 | Fed. Rep. of Germany . | |
| 3528248 | 2/1987 | Fed. Rep. of Germany . | |
| 2244415 | 4/1975 | France . | |
| 2494217 | 5/1982 | France | 53/53 |
| 2167724 | 6/1986 | United Kingdom . | |

*Primary Examiner*—James F. Coan

*Attorney, Agent, or Firm*—Sughrue, Mion, Zinn, Macpeak & Seas

[57] ABSTRACT

In the packaging of articles, especially brittle articles, such as biscuits or the like, a test must be carried out to ensure that the pack content is complete and intact. For this purpose, each pack (10) is tested, during its continuous conveyance via conveying means (17 to 20), by means of at least one mechanical feeler (21) taken along with it in the conveying direction. This feeler (21) is pressed onto the soft pack with a specific force by means of its feeler plunger (22) via a spring (26). A fault in the pack content is revealed when the feeler plunger (22) comes to rest outside a specific region monitored by light barriers (33) which check the position of an end portion of the feeler (21).

22 Claims, 5 Drawing Sheets

PROCESS AND APPARATUS FOR THE TESTING OF PACKS

BACKGROUND OF THE INVENTION

The invention relates to a process for the testing of packs for a plurality of articles, especially biscuits, the articles being arranged in ordered groups (stacks) and being surrounded by a deformable wrapping. The invention also relates to an apparatus for the testing of articles or groups of these.

In the packaging of articles, one problem is that the manufacturer has to ensure that the pack content is correct. If, for example, the pack content consists of a specific number of identical individual articles, such as biscuits, there must be neither one short nor one too many. Furthermore, none of the biscuits may be broken or have been put askew during packaging. The check conducted hitherto on the still open pack often cannot give any information on this because faults of this type can occur when the soft pack is being closed.

SUMMARY OF THE INVENTION

The object on which the invention is based is to carry out the testing of the content of packs quickly, accurately and at a low outlay.

To achieve the object, the process according to the invention is characterized in that the number of articles and/or their correct arrangement within the wrapping are tested by feelers movable against the latter, this at the same time undergoing deformation, and defective packs detected in this way are separated out.

Thus, the articles or groups of these are tested inside the pack which consists of a wrapping deformable at least in the part regions important for testing. For this, a test member, in particular a feeler assigned to each group, penetrates deeper into the pack when articles within a group are missing, the wrapping thereby experiencing correspondingly greater deformation. When articles within a group are askew and the dimensions of the latter are enlarged as a result, the test member, that is to say the feeler, can also undergo a shift in another direction.

During the testing of a pack, the relative position of the feelers is monitored, especially by optoelectrical members. Deviations of the feeler from a middle or normal position trigger an error signal, the result of which is that the pack is separated out.

According to a further feature of the invention, the packs are tested during their transport. The test members, in particular mechanical feelers, are conveyed in synchronism with the particular pack to be tested. If the stacks of articles (biscuits) are arranged transversely relative to the conveying direction, feelers are appropriately assigned to each stack on both sides of the pack. Testing is carried out in the region of a limited test zone of a conveyor for the packs.

The feelers are preferably arranged on the conveyor for the packs themselves, especially on lateral toothed belts. The feelers or a housing (guide) of these are appropriately connected firmly to the associated toothed belt, especially formed on this as an integral work-piece. The toothed belts are therefore produced with groups of feelers or housings (guides) for these feelers which are arranged at a distance from one another.

Any defective packs detected are eliminated in the region of the conveying zone, especially by means of a downward-pointing ejection shaft arranged in the region of the conveyor for the packs. During the transport of intact packs, this ejection shaft is covered at least partially. When a defective pack is identified, the ejection shaft is opened, so that the defective pack conveyed passes automatically into the ejection shaft.

Further features of the invention relate to the design of the conveyor for the packs, and, above all, to the feeler members.

An exemplary embodiment of the invention is explained in greater detail below with reference to the drawings.

BRIEF DESCRIPTION OF THE DRAWINGS

In these.

DETAILED DESCRIPTION OF A PREFERRED EMBODIMENT

Figure 1:
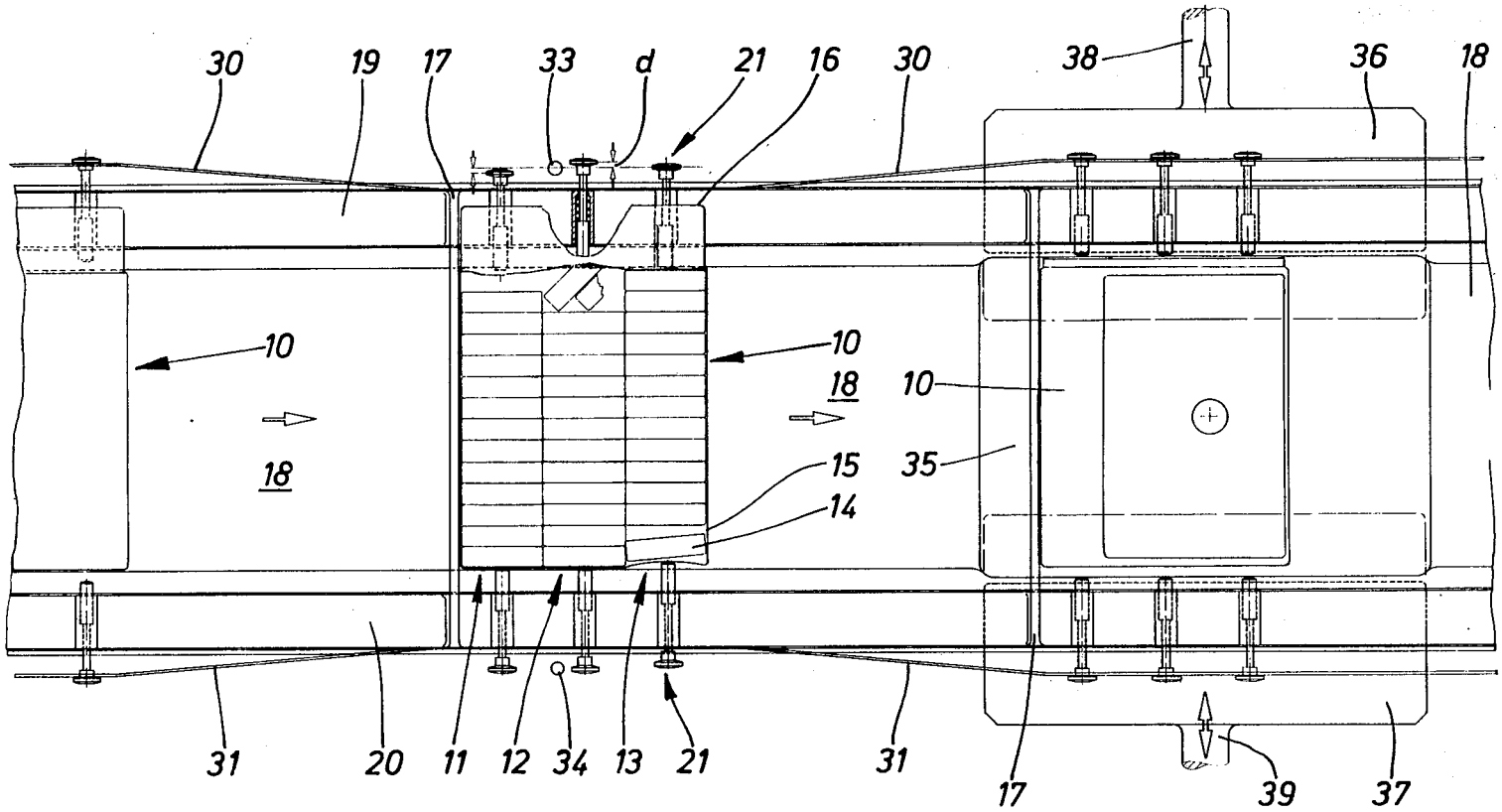
FIG. 1 shows an apparatus for the testing of the content of packs in a diagrammatic plan-view representation.
Figure 2:
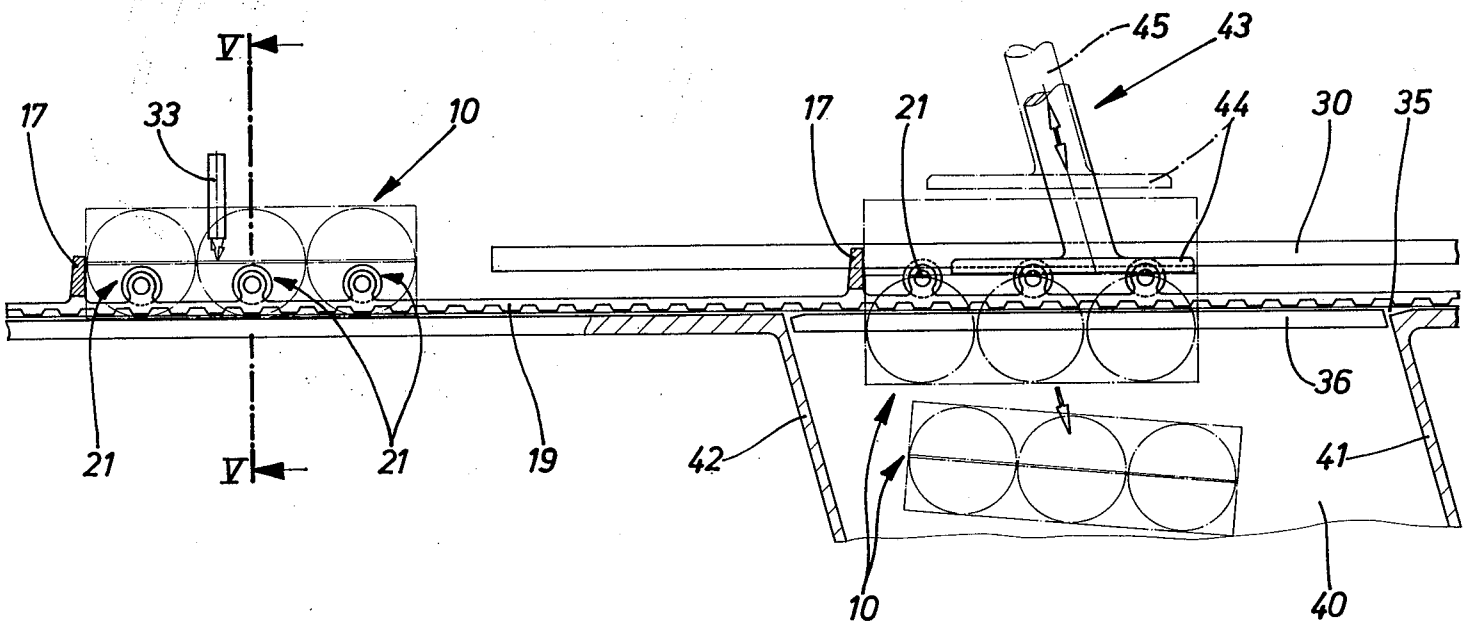
FIG. 2 shows a side view of FIG. 1.
Figure 3:
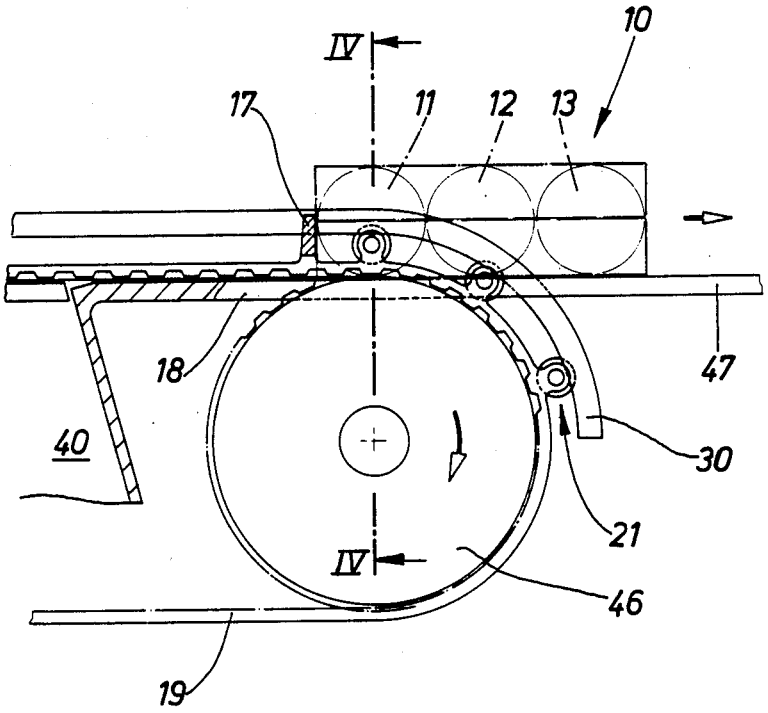
FIG. 3 shows a side view of an end portion of a conveyor on an enlarged scale.
Figure 4:
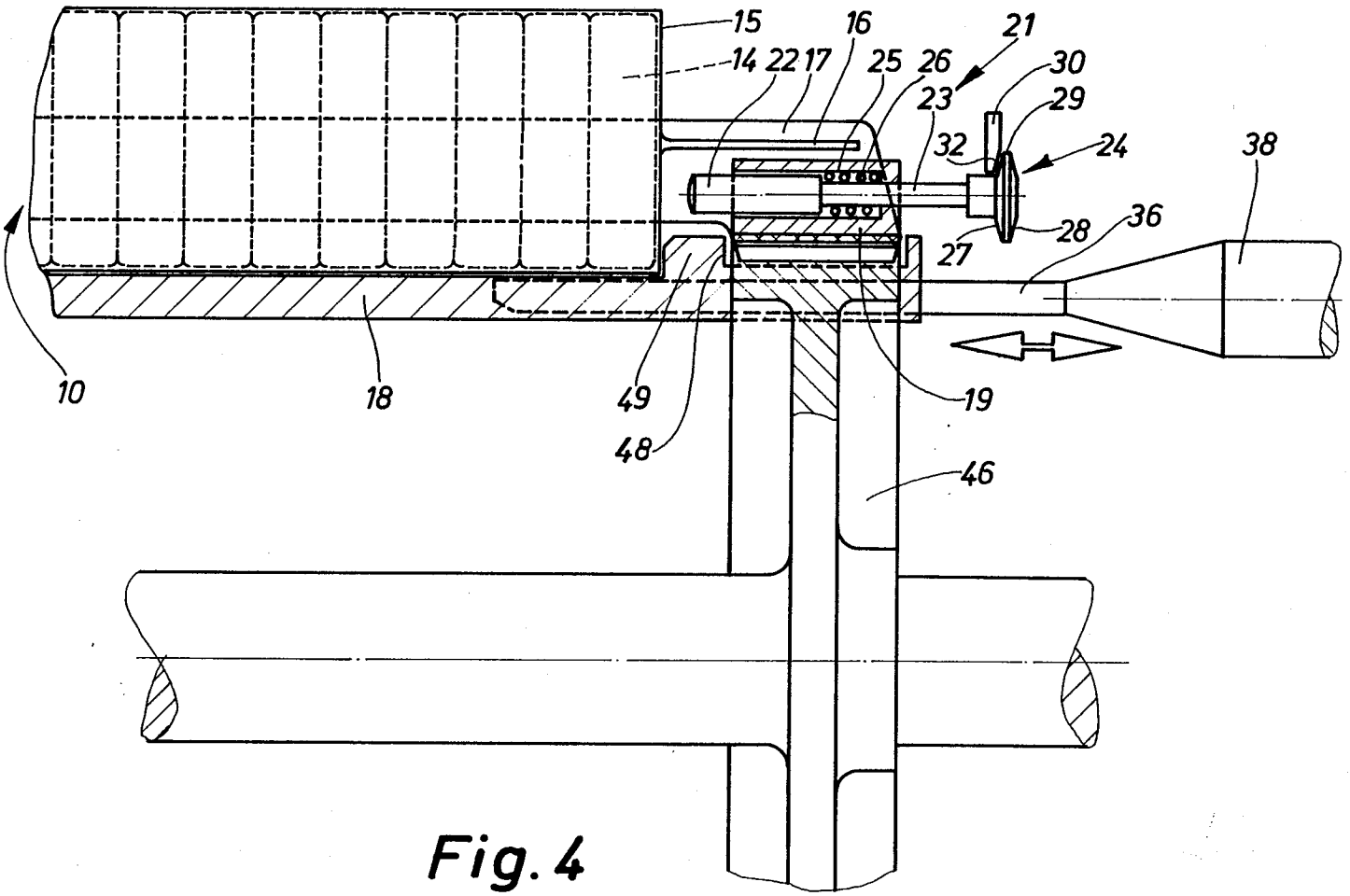
FIG. 4 shows a vertical section along the plane IV—IV in FIG. 3 on a further-enlarged scale.
Figure 5:
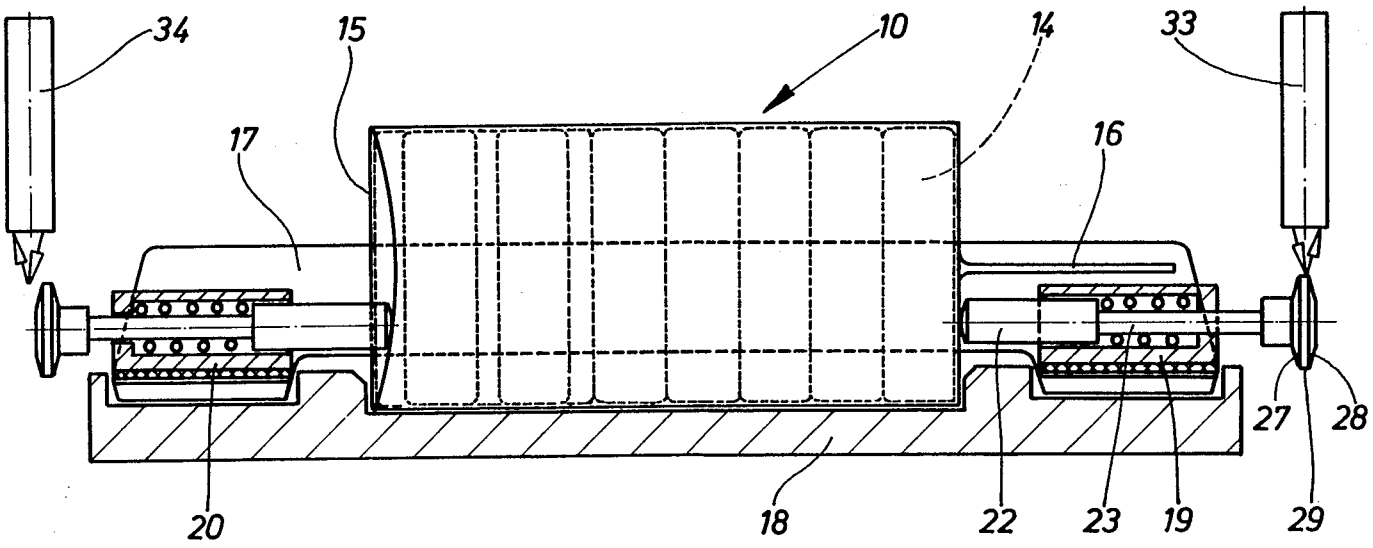
FIG. 5 shows a vertical section along the plane V—V in FIG. 2, likewise on an enlarged scale.

The apparatus described below serves for the testing of the content of packs 10 which, in the example shown here, each contain three stacks 11, 12, 13 of (round) biscuits 14. The soft packs have a wrapping 15 which consists of transparent film and which is equipped with a gripping tab 16 on one (end) face as a result of welding together.

The packs 10 are pushed over a sliding track 18 by strip-shaped take-up crossmembers 17. The take-up crossmembers 17 are fastened to toothed belts 19, 20 which rotate on both sides of the sliding track 18.

Feelers 21 are fastened to the toothed belts 19, 20, specifically one feeler 21 for each end face of a stack 11, 12, or 13. The feelers 21 have a feeler plunger 22 which is connected to an engagement means 24 via a ram 23. The feeler plunger 22 rests in a guide 25 which is formed on the toothed belt 19, 20. The guide 25, at its end facing away from the feeler plunger 22, is provided with a bore through which the ram 23 passes. Inserted between the inner end of the guide 25 and the rear end of the feeler plunger 22 is a compression spring 26 which loads the feeler plunger 22 in the direction of the pack 10.

The feelers 21 are designed or connected to the toothed belts 19, 20 in a special way. For this purpose, the cylindrical feeler housings designated as the guide 25 and intended for receiving the feeler plunger 22 and the ram 23 are formed on the toothed belts 19, 20 or are designed as a joint integral work-piece with these. To that extent, therefore, the feelers or their guides 25 are produced together with the toothed belts 19, 20.

The engagement means 24 of the feeler 21 is made disk-shaped and has conical end faces 27, 28 which are connected to one another via a cylindrical portion 29.

Parallel to the sliding track 18 or to the toothed belts 19, 20, there are on both sides rails 30, 31, the lower edge 31 of which is shaped, on the outside, so as to match the inner end face 27 of the engagement means 24. At the same time, the rails 30, 31 are arranged in such a way that the engagement means 24 rest by means of their inner end face 27 against the bevelled lower edge 32 of the rails 30, 31 and can slide along on this when the toothed belts 19, 20 move in the direction of the arrow.

The rails 30, 31 are fastened parallel to the toothed belts 19, 20 over the entire conveying zone, with the exception of a short portion. In front of this short portion, the rails 30, 31 converge in the direction of the toothed belts 19, 20 and end just before this portion. After this portion, the rails 30, 31 diverge again.

In the region where the rails 30, 31 are not provided or are at their shortest distance from the toothed belts 19, 20, a reflection light barrier 33, 34 is attached on each side. The light barriers 33, 34 are directed towards the path of movement of the engagement means 24 perpendicularly relative to the conveying plane, in such a way that, when there is an intact stack, the cylindrical portion 29 of the engagement means 24 moves along directly under the associated light barrier 33, 34.

When, during operation, a pack 10 is pushed over the sliding track 18 via the toothed belts 19, 20 by means of the take-up crossmember 17, the engagement means 24 first rest by means of their inner end faces 27 against the lower edges 32 of the rails 30, so that the plungers 22 are pulled back from the pack 10 and the springs 26 are compressed. When the engagement means 24 enter the region in which the rails 30, 31 approach one another, the plungers 22 run onto the end faces of the packs 10 as a result of the force of the springs 26. If the pack content, namely the stack, has the prescribed height, as shown in FIG. 1 at the left-hand end of the leading stack 13 (as seen in the conveying direction) and at the left-hand ends of the stacks 11, 12, the cylindrical portion 29 of the engagement means 24 runs past exactly underneath the reflection light barriers 33 and 34, so that these transmit a maximum reflection signal. However, if a biscuit was broken when the pack was being closed, so that the stack 12 is higher than prescribed, the light emitted by the reflection light barriers 33, 34 does not arrive at the cylindrical portion 29 but at the conical portion 27 and is therefore not reflected back to the light barrier 33, 34. In the same way, if there is an incomplete stack 11, the light does not arrive at the cylindrical portion 29, but as the outer end face 28 and is likewise not reflected. Thus, it is possible to make an exact distinction between the positions and consequently detect defective pack contents accurately. An essential factor here is also the conical shape of the end faces 27, 28 with the cylindrical portion located between them. In particular, as a result of these differences in shape, it is possible to make an especially sharp distinction between the correct position and a fault-indicating position of the engagement means 24 or of the feeler plunger 22. Only when the feeler plunger 22 is pressed outwards so far that the light of the reflection light barrier 33, 34 strikes the cylindrical connecting piece between the engagement means 24 and the ram 23 can larger error signals occur. The working range of the arrangement can thus be determined by the slope of the end faces 27, 28.

The light barriers 23, 24 are connected to a logical evaluation unit (not shown here) which determines whether a pack is to be classed as defective or not. If a pack 10 is classed as defective, it has to be separated out.

For separating out defective packs, a cut-out 35 is made in the sliding track 18 shortly after the region in which the feelers 21 sense the packs 10. The cut-out 35 extends over the entire width of the sliding track 18 and over a length which is somewhat greater than the width of a pack 10. The cut-out 35 can be partially covered by two covering blades 36, 37, the faces of the covering blades 36, 37 being essentially flush with the surface of the sliding track 18. The covering blades 36, 37 are fastened to guide rods 38, 39 which form piston rods of pneumatic cylinders or the like (not shown). The covering blades 36, 37 can be drawn out via these pneumatic cylinders, until the cut-out 35 is opened completely, or can be moved into the cutout 35, until a delivered pack 10 can slide across the cut-out 35 on the covering blades 36, 37.

An ejection shaft 40 is arranged underneath the cut-out 35. The ejection shaft 40 has a front wall 41 and a rear wall 42 which extend parallel to one another and which are inclined in the conveying direction.

Arranged above the cut-out 35 is an ejector punch 43, the punch plate 44 of which has a face parallel to the sliding track 18 and is connected to a ram 45 attached to the punch plate 44 at an inclination. This inclination corresponds to the inclination of the ejection shaft 40. The ram 45 is connected for actuation purposes to a pneumatic cylinder (or the like) (not shown).

When it has been found by means of the light barriers 33, 34 that a pack is defective, the covering blades 36, 37 are drawn back via the control (not shown), and when the defective pack 10 arrives the ejector punch 43 is moved down so that the defective pack 10 is conveyed downwards into the ejection shaft 40. The special arrangement of the ejector punch 43 and of the ejection shaft 40 in respect of the direction of ejection guarantees that the packs 10 to be ejected can execute only an insignificant relative movement in relation to the punch plate 44, if at all, and can therefore be ejected in a particularly effective and faultless way. The control device which receives the signals from the light barriers 33, 34 and which then activates the actuation means for the covering blades 36, 37 and the ejector punch 43 is synchronized with the drive for the toothed belts 19, 20, so that ejection at exactly the right time is possible.

Those packs 10 recognized to be perfect are transferred to a conveying chute 47 in the region of deflecting rollers 46 deflecting the toothed belts 19, 20 and then enter a further section (not shown here) of the packaging apparatus.

The rails 30, 31 are brought together again in the region of the deflecting roller 46, so that the springs 26 can push the feeler plungers 22 inwards again and the engagement means 24 of the feelers 21 can run freely during the advance of the latter. Correspondingly, at the second deflecting roller (not shown here), the engagement means 24 are again brought up to appropriately diverging portions of the rails 30, 31 and then pull the plungers 22 back into the guides 25 once more, so that the packs 10 can be deposited freely.

It also emerges from the drawings that, at the same time, the sliding track 18 is equipped on its outer portion with belt guides 48 for the toothed belts 49. Furthermore, the sliding track 18, at its edges, has guide fences 49 for guiding the packs 10, so that these cannot tilt or come up to the retracted feeler plungers 22. Moreover, the guide fences 49 ensure that, during the testing operation carried out by the feelers 21, the packs 10 assume a specific position in relation to these feelers.

What is claimed is:

1. Process for testing the desired height of a stack of articles (14) in a pack wrapped in a deformable wrapping (15), the stack height resulting from arranging the articles in layers one adjacent to another, whereby the desired height to be tested is a result of the number of articles and their correct arrangement in the stack, said process comprising the steps of:

positioning a stack, including the wrapping (15), between two test feelers (21) which are located opposite one another and at least one of which is movable in the direction of the stack height against the wrapping at an end of the pack (10);

then moving the movable test member in the height direction against the wrapping (15) at the end of the pack until the movable test member meets with resistance at the end of the stack;

determining from an end position of the movable test member whether the stack has the desired height; and when the end position is indicative of a defective stack having other than the desired height, separating from a series of packs the pack containing the defective stack.

2. Process according to claim 1, comprising the steps of continuously conveying, in a conveying direction, a series of packs (10) to be tested, and moving the feelers (21) with the conveyed packs and at the same speed as the conveying speed of the packs.

3. Process according to claim 2, wherein the stacks (11, 12, 13) of articles (14) are oriented in the packs (10) transversely relative to the conveying direction, and further comprising the step of moving the movable feeler (21) transversely relative to the conveying direction in a region of a test zone.

4. Apparatus for testing the desired height of a stack of articles (14) in a pack wrapped in a deformable wrapping (15), the stack height resulting from arranging the articles in layers one adjacent to another, whereby the desired height to be tested is a result of the number of articles and their correct arrangement in the stack, said apparatus comprising:

checking means comprising two test feelers (21) which are located opposite one another and between which a stack to be tested is positioned;

means for moving at least one of said test feelers (21) in the direction of the stack height against the wrapping at an end of the stack in a pack to deform the wrapping (15) until the moved test member meets with resistance at the end of the stack; and means for detecting an end position of the moved test feeler as a defective pack having other than the desired height and triggering an error signal for indicating the defective pack which is to be separated from a series of packs being tested.

5. Apparatus according to claim 4, characterized in that the feelers (21) have at least one elastically displaceable feeler plunger (22) which comes to rest against an outer article (14) of the pack or of stacks (11, 12, 13) and of which the relative position in the movable feeler (21) determines the triggering of the error signal.

6. Apparatus according to claim 5, characterized in that the feeler plunger (22) is mounted, together with a ram (23) in a housing or in a guide (25) of the feeler (21) so as to be axially displaceable and is supported on a spring (26).

7. Apparatus according to claim 4, comprising sensor means (33, 34) for sensing the end position of the moved feeler (21).

8. Apparatus according to claim 7, comprising:

conveyor means for transporting the articles or stacks (11, 12, 13) or packs (10), said feelers being arranged on both sides of the conveyor means and being located opposite one another, and two of said feelers being assigned to each of the stacks (11, 12, 13) and being arranged transversely relative to the conveying direction.

9. Apparatus for the testing of packs for a plurality of articles arranged in stacks within the packs which are wrapped in a deformable wrapping, comprising:

checking means for checking the number of articles (14) or their correct arrangement in stacks (11, 12, 13) and including mechanical feelers (21) movable against the stacks (1, 12, 13) of articles (14) or against a deformable wrapping (15) thereof, said feelers experiencing a change in position if an article is missing or the formation of a stack is incorrect;

sensor means for sensing said change in position and producing an error signal; and conveyor means for transporting the articles or stacks (11, 12, 13) or packs (10), said feelers being arranged on both sides of the conveyor and being located opposite one another, and two of said feelers being assigned to each of the stacks (11, 12, 13) and being arranged transversely relative to the conveying direction;

said conveyor means having at least two lateral toothed belts (19, 20) which are arranged at a distance from one another and to which the feelers (21) are attached.

10. Apparatus according to claim 9, wherein the feelers (21) comprise feeler plungers (22), and further comprising housings or guides (25) in which are mounted said feeler plungers (22) together with corresponding rams (23), the feelers (21) being connected to the toothed belts (19, 20) by being formed on them, in such a way that said housings or guides (25), which receive the feeler plungers (22) together with the rams (23), are formed as an integral workpiece with the toothed belts (19, 20).

11. Apparatus according to claim 9, characterized in that the toothed belts (19, 20) are connected to one another by means of take-up crossmembers (17), a sliding track (18) for supporting the packs (10) being arranged between the toothed belts (19, 20).

12. Apparatus according to claim 9, characterized in that the feelers (21) are in a test position only in the region of a test zone of the conveyor means and outside this region are out of the test position.

13. Apparatus according to claim 12, characterized in that engagement means (24) are arranged at the feelers ends facing away from the packs (10) and are removable into engagement with adjusting members.

14. Apparatus according to claim 13, characterized in that stationary rails (30, 31) extending parallel to the conveyor means (17, 20) are mounted next to the conveyor means, in such a way that the engagement means (24) of the feelers (21) are brought into sliding engagement with the rails (30, 31) and moved away from the packs (10).

15. Apparatus according to claim 11 characterized in that the sliding track (18) has an at least partially closable cutout (35) of essentially the size of the packs (10) or somewhat larger, and the cut-out (35) is openable in order to separate out defective packs.

16. Apparatus according to claim 15, characterized in that the cut-out (35) is coverable by two covering blades (36, 37) which project inwards from sides of the conveyor means (19, 20) and which are displaceable parallel to the sliding track (18) and perpendicularly relative to the conveying direction via actuating means.

17. Apparatus according to claim 15, characterized in that an ejection shaft (40) is arranged underneath the cut-out (35).

18. Apparatus according to claim 15, characterized in that an ejector punch (43) is arranged above the cut-out (35) and is movable towards the cut-out (35).

19. Apparatus according to claim 18, characterized in that the direction of movement of the ejector punch (43) is inclined relative to the conveying direction in such a way that, when a defective pack (10) is ejected, there is essentially no relative movement between the punch (43) and the pack (10) in the conveying direction.

20. Apparatus according to claim 13, characterized in that the sensor means (33, 34) are arranged in a stationary manner, so that the position of the feelers (21) is sensed during their run past the sensor means (33, 34).

21. Apparatus according to claims 20, characterized in that the sensor means reflection are light barriers (33, 34) arranged perpendicularly relative to the direction of movement of the feelers (21) and are arranged in such a way that, when the pack content is correct, an edge of the essentially disk-shaped engagement means (24) is in the reflection range of the light barriers (33, 34).

22. Apparatus according to claim 21, characterized in that the engagement means (24) have a cylindrical portion (29) which is limited on both sides by conically tapering end faces (27, 28).

* * * * *